US012790675B2

(12) United States Patent
Neddemeyer et al.

(10) Patent No.: US 12,790,675 B2
(45) Date of Patent: Nov. 10, 2026

(54) MARTENSITIC STEEL WITH RETARDED Z PHASE FORMATION, POWDER AND BLANK OR COMPONENT

(71) Applicant: Siemens Energy Global GmbH & Co. KG, Munich (DE)

(72) Inventors: Torsten Neddemeyer, Falkensee (DE); Axel Bublitz, Berlin (DE); Torsten-Ulf Kern, Wesel (DE); Karsten Kolk, Mülheim a.d. Ruhr (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 809 days.

(21) Appl. No.: 18/032,390

(22) PCT Filed: Sep. 1, 2021

(86) PCT No.: PCT/EP2021/074098

§ 371 (c)(1),
(2) Date: Apr. 18, 2023

(87) PCT Pub. No.: WO2022/083928

PCT Pub. Date: Apr. 28, 2022

(65) Prior Publication Data

US 2023/0392245 A1 Dec. 7, 2023

(30) Foreign Application Priority Data

Oct. 23, 2020 (DE) ..... 10 2020 213 394.8

(51) Int. Cl.

| | |
|---|---|
| ***C22C 38/54*** | (2006.01) |
| ***B22F 1/10*** | (2022.01) |
| ***B22F 1/12*** | (2022.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |

(52) U.S. Cl.

CPC ..... *C22C 38/54* (2013.01); *B22F 1/10* (2022.01); *B22F 1/12* (2022.01); *C22C 38/001* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01)

(58) Field of Classification Search

CPC ..... C22C 38/54; C21D 2211/008

See application file for complete search history.

(56) References Cited

U.S. PATENT DOCUMENTS

| | | | | |
|---|---|---|---|---|
| 5,749,228 | A | 5/1998 | Shiga | |
| 5,911,842 | A | 6/1999 | Shiga | |
| 10,077,490 | B2 | 9/2018 | Valls | |
| 2017/0292179 | A1* | 10/2017 | Hackett | C22C 38/001 |
| 2020/0208245 | A1* | 7/2020 | Neddemeyer | C22C 38/20 |

FOREIGN PATENT DOCUMENTS

| | | | |
|---|---|---|---|
| CN | 102517507 | B | 6/2012 |
| CN | 111133120 | A | 5/2020 |
| EP | 2662462 | A1 | 11/2013 |
| JP | H08120414 | A | 5/1996 |
| JP | H08225832 | A | 9/1996 |
| JP | H09291308 | A | 11/1997 |
| JP | H1192881 | A | 4/1999 |
| JP | H11350031 | A | 12/1999 |
| JP | 2001192781 | A | 7/2001 |
| JP | 2002224798 | A | 8/2002 |
| JP | 2002235154 | A | 8/2002 |
| JP | 2003105411 | A | 4/2003 |
| JP | 2008291360 | A | 12/2008 |
| JP | 2017507251 | A | 3/2017 |
| JP | 2020147785 | A | 9/2020 |
| WO | 9200158 | A1 | 1/1992 |

OTHER PUBLICATIONS

PCT International Search Report and Written Opinion of International Searching Authority mailed Dec. 23, 2021 corresponding to PCT International Application No. PCT/EP2021/074098 filed Sep. 1, 2021.

Danielson, Hilmar Kjartansson, and John Hald. "Behaviour of Z phase in 9-12% Cr steels." Energy materials 1.1 (2006): 49-57; XP002440821; ISSN: 1748-9237; DOI: 10.1179/174892306X99732; 2006.

Fedoseeva A. E., et al. "Formation of Z-Phase Particles in a Martensitic 9% Cr Steel during Creep at 650° C. and Their Influence on the Creep." Russian Metallurgy (Metally) 2019 (2019): 932-938; XP036989422; ISSN: 0036-0295; DOI: 10.1134/S0036029519100069; 2019.

(Continued)

*Primary Examiner* — Alexandra M Moore

(74) *Attorney, Agent, or Firm* — Wolter Van Dyke Davis, PLLC

(57) ABSTRACT

Martensitic steel with Z phase, powder, and blank or component—alloy, at least including (in % by weight): carbon (C): 0.16%-0.24%, silicon (Si): 0.0%-0.08%, manganese (Mn): 0.04%-0.16% chromium (Cr): 10.6%-11.5%, molybdenum (Mo): 0.5%-0.9%, tungsten (W): 2.2%-2.6%, cobalt (Co): 3.0%-3.6%, nickel (Ni): 0.09%-0.19%, boron (B): 0.0035%-0.01%, nitrogen (N): 0.001%-0.025%, titanium (Ti): 0.01%-0.04%, copper (Cu): 1.20%-2.30%, optionally vanadium (V): 0.10%-0.30%, niobium (Nb): 0.02%-0.08%, aluminium (Al): 0.003%-0.06%, balance: iron (Fe).

20 Claims, No Drawings

(56) References Cited

OTHER PUBLICATIONS

Golpayegani, Ardeshir, et al. "A study on Z-phase nucleation in martensitic chromium steels." Materials Science and Engineering: A 489.1-2 (2008): 310-318.

Zou Yuqing et al., "Automobile Materials", Beijing Institute of Technology Press, Feb. 28, 2015, p. 96, ISBN 978-7-5682-0276-3 [English machine translation attached].

* cited by examiner

MARTENSITIC STEEL WITH RETARDED Z PHASE FORMATION, POWDER AND BLANK OR COMPONENT

CROSS REFERENCE TO RELATED APPLICATIONS

This application is the US National Stage of International Application No. PCT/EP2021/074098 filed 1 Sep. 2021, and claims the benefit thereof. The International Application claims the benefit of German Application No. DE 10 2020 213 394.8 filed 23 Oct. 2020. All of the applications are incorporated by reference herein in their entirety.

FIELD OF INVENTION

The invention relates to a martensitic steel with retarded Z-phase formation, to powder, and also to a blank or a component composed thereof.

BACKGROUND OF INVENTION

Forged rotor disks of turbines, especially gas turbines, have to date been produced from various forging steels in correlation to service conditions. For instance, a steel based on NiCrMoV is used for compressor disks and a steel based on CrMoWVNbN for turbine disks. The service conditions and the design requirements are critical to the choice of the forging material.

For the selection of a forging material, it is always necessary to ensure a balance of strength and toughness in order to meet the design requirements.

The material having the highest usage temperature is currently a steel based on CrMoWVNbN and also a steel based on CrMoCoVB.

Both materials, however, are at their limits for usage above 773 K.

Nevertheless, current studies suggest that ferrous alloys can be utilized up to 900 K.

For higher usage temperatures, nickel materials are currently being debated.

The nickel-based components unfortunately have disadvantages as follows, necessitating that their usage be weighed up:

higher costs in comparison to the disk made of steel,
new fracture-mechanical approaches have to be developed,
longer machining times in manufacturing.

SUMMARY OF INVENTION

It is therefore an object of the invention to solve the above-stated problem, and more particularly to increase the hot strength, to enable even higher usage temperatures, meaning an increase by at least 20 K to 30 K.

The object is achieved by an alloy, a powder, and a blank or component as claimed.

The dependent claims list further advantageous measures which may be combined with one another as desired in order to achieve further advantages.

DETAILED DESCRIPTION OF INVENTION

The alloy composition of martensitic steels has hitherto been limited by the formation of the Z-phase within the period of utilization of the component.

The alloy of the invention comprises at least (in % by weight):

carbon (C): 0.16%-0.24%,
preferably 0.19%-0.21%,
silicon (Si): 0.0%-0.08%,
preferably 0.0%-0.06%,
very preferably 0.02%-0.06%,
manganese (Mn): 0.04%-0.16%,
preferably 0.07%-0.13%,
chromium (Cr): 10.6%-11.5%,
preferably 11.2%-11.5%,
very preferably 11.2%,
molybdenum (Mo): 0.5%-0.9%,
preferably 0.7%,
tungsten (W): 2.2%-2.6%,
preferably 2.3%-2.5%,
very preferably 2.45%,
cobalt (Co): 3.0%-3.6%,
preferably 3.25%-3.40%,
nickel (Ni): 0.09%-0.19%
preferably 0.13%-0.17%,
boron (B): 0.0035%-0.01%
preferably 0.004%-0.006%,
nitrogen (N): 0.001%-0.025%,
preferably 0.011%-0.015%,
titanium (Ti): 0.01%-0.04%,
preferably 0.018%-0.028%,
copper (Cu): 1.20%-2.30%,
preferably 1.65%-1.85%,
optionally
vanadium (V): 0.10%-0.30%,
preferably 0.15%-0.25%,
niobium (Nb): 0.02%-0.08%
preferably 0.04%-0.06%,
aluminum (Al): 0.003%-0.06%,
more particularly 0.005%-0.04%,
balance iron (Fe),
more particularly consisting of these elements.

In steel making, silicon (Si) has the positive effect of reducing melt viscosity, and also serves as a deoxidizing agent. A further positive influence of silicon (Si) is that it raises the tensile strength, yield point, and scale resistance.

Furthermore, the fractions of chromium (Cr) and cobalt (Co) play an important part. They raise the oxidation resistance and increase the hot strength.

A titanium (Ti)/nitrogen (N) ratio of from 1.5 to 2 has proven advantageous.

The new approach allows the formation of the Z-phase to be shifted toward 200 000 h.

One advantageous exemplary embodiment is as follows (in % by weight):

carbon (C): 0.20%
silicon (Si): <0.08%
manganese (Mn): 0.10%,
chromium (Cr): 11.2%,
molybdenum (Mo): 0.7%,
tungsten (W): 2.4%,
cobalt (Co): 3.3%,
nickel (Ni): 0.15%,
boron (B): 0.005%,
nitrogen (N): 0.013%,
titanium (Ti): 0.02%,
vanadium (V): 0.20%,
niobium (Nb): 0.05%,
copper (Cu): 1.75%,
aluminium (Al): 0.02%,
balance iron (Fe).

As well as the use as a forged disk in the gas turbine, further uses are conceivable, such as, for example, gas turbine compressor blades, steam turbine blades, or as a forged steam turbine part.

The advantages are as follows:

expansion of the usage range of "inexpensive" iron-based alloys by comparison with "expensive nickel-based materials", faster machinability of the rotor components based on iron (10.6%-11.5% chromium (Cr)) by comparison with nickel-based materials, experience from the construction, manufacture, and production of the highly alloyed iron-based alloys can largely be carried out; this helps, for example, in all probabilistic approaches, such as fracture mechanics, to minimize the risk, service temperature can be raised and therefore enables power boosting and performance boosting of the machine without any need for external cooling.

The invention claimed is:

1. An alloy comprising (in % by weight):
carbon (C): 0.16%-0.24%,
silicon (Si): 0.0%-0.08%,
manganese (Mn): 0.04%-0.16%,
chromium (Cr): 10.6%-11.5%,
molybdenum (Mo): 0.5%-0.9%,
tungsten (W): 2.2%-2.6%,
cobalt (Co): 3.0%-3.6%,
nickel (Ni): 0.09%-0.19%,
boron (B): 0.0035%-0.01%,
nitrogen (N): 0.001%-0.025%,
titanium (Ti): 0.015%-0.035%,
copper (Cu): 1.30%-2.00%,
optionally
vanadium (V): 0.10%-0.30%,
niobium (Nb): 0.02%-0.08%,
aluminum (Al): 0.003%-0.06%, and
balance iron (Fe).

2. A powder comprising
an alloy as claimed in claim 1,
optionally comprising a binder or ceramic particles.

3. A blank or component, comprising:
an alloy as claimed in claim 1,
which is cast and/or forged and/or heat-treated and/or machined.

4. The alloy as claimed in claim 1,
containing 0.2% by weight of carbon (C).

5. The alloy as claimed in claim 1,
containing 0.02%-0.06% by weight of silicon (Si).

6. The alloy as claimed in claim 1,
containing 0.10% by weight of manganese (Mn).

7. The alloy as claimed in claim 1,
containing 10.6%-11.0% by weight of chromium (Cr).

8. The alloy as claimed in claim 1,
containing 11.0%-11.4% by weight of chromium (Cr).

9. The alloy as claimed in claim 1,
containing 0.70% by weight of molybdenum (Mo).

10. The alloy as claimed in claim 1,
containing 2.40% by weight of tungsten (W).

11. The alloy as claimed in claim 1,
containing 3.3% by weight of cobalt (Co).

12. The alloy as claimed in claim 1,
containing 0.15% by weight of nickel (Ni).

13. The alloy as claimed in claim 1,
containing 0.005% by weight of boron (B).

14. The alloy as claimed in claim 1,
containing 0.013% by weight of nitrogen (N),
not beyond impurity level.

15. The alloy as claimed in claim 1,
containing 0.020%-0.026% by weight of titanium (Ti).

16. The alloy as claimed in claim 1,
containing 0.20% by weight of vanadium (V).

17. The alloy as claimed in claim 1,
containing 0.05% by weight of niobium (Nb).

18. The alloy as claimed in claim 1,
containing 1.75% by weight of copper (Cu).

19. The alloy as claimed in claim 1,
containing 0.02% by weight of aluminum (Al).

20. The alloy as claimed in claim 1,
having a titanium (Ti)/nitrogen (N) ratio of from 1.5 to 2.

* * * * *